United States Patent [19]

Blaschke et al.

[11] 4,248,550

[45] Feb. 3, 1981

[54] PILE EXTRACTION APPARATUS

[75] Inventors: Kurt Blaschke, Saarbrücken-Dudweiler; Josef Roob, St. Wendel, both of Fed. Rep. of Germany

[73] Assignee: Stahl-Und Apparatebau Hans Leffer GmbH, Saarbrücken-Dudweiler, Fed. Rep. of Germany

[21] Appl. No.: 13,811

[22] Filed: Feb. 22, 1979

[30] Foreign Application Priority Data

Feb. 22, 1978 [DE] Fed. Rep. of Germany ..... 2807510

[51] Int. Cl.[3] ..... E02D 9/02

[52] U.S. Cl. ..... 405/232; 294/94; 294/86.25; 173/49; 173/130

[58] Field of Search ..... 405/232, 285; 173/49, 173/130, 131, 134; 279/109; 254/29, 30, 106; 294/93, 94, 86.24, 86.25

[56] References Cited

U.S. PATENT DOCUMENTS

| | | | |
|---|---|---|---|
| 1,736,104 | 11/1929 | Warrington | 173/130 X |
| 2,080,673 | 5/1937 | Roemer | 254/30 |
| 2,743,585 | 5/1956 | Berthet et al. | 173/49 X |
| 3,088,769 | 5/1963 | Richardson | 294/93 |
| 3,101,956 | 8/1963 | Muller | 173/131 X |
| 3,109,500 | 11/1963 | Glawon | 173/131 X |
| 3,149,851 | 9/1964 | Adams | 173/130 X |
| 3,763,654 | 10/1973 | Matsushita | 405/232 |

FOREIGN PATENT DOCUMENTS

| | | | |
|---|---|---|---|
| 1190887 | 4/1965 | Fed. Rep. of Germany | 254/29 A |
| 2216229 | 10/1973 | Fed. Rep. of Germany | 405/232 |
| 891188 | 3/1962 | United Kingdom | 173/49 |
| 445730 | 11/1975 | U.S.S.R. | 173/49 |
| 497379 | 3/1976 | U.S.S.R. | 173/49 |

*Primary Examiner*—Dennis L. Taylor

*Attorney, Agent, or Firm*—John J. Dennemeyer

[57] ABSTRACT

Pile extraction apparatus having a clamping device for clamping engagement with a pile. The device is suspended from a section of casing pipe by way of a universal joint. In this way the extraction apparatus may be raised and lowered by a commercially available pipe extraction machine.

8 Claims, 2 Drawing Figures

PILE EXTRACTION APPARATUS

This invention relates to pile extraction apparatus.

For example, the invention relates to an apparatus for progressively extracting piles, in particular H-girders, by means of a hydraulic press, consisting of a clamping device which is arranged to move on all sides with respect to the presses supported on the ground. An apparatus of this type is disclosed in Gernam Auslegesschrift 1,634,622. In this known apparatus, the clamping device is connected to the piston rods of four vertical hydraulic press cylinders, which are supported by way of a base plate on the ground. A special hydraulic press arrangement is thus required for pile extraction.

It has now been appreciated that the special press arrangement for extracting piles can be dispensed with if the extraction apparatus is set up for the inclusion of a commercially available pipe extraction machine (possibly according to Gebrauchsmuster 7 718 042 and U.K. Patent Application No. 18768/78) which is present in any case in building projects for producing pile foundations. Thus, the object of the invention is to provide pile extraction apparatus in which the hydraulic press arrangement for progressively extracting the piles is a commercially available pipe extraction machine, by which casing pipes are extracted after concreting.

The invention consists in that the clamping device is connected to a section of casing pipe by way of a universal joint. The curved clamping jaws of a commercially available pipe extraction machine can be pressed against this section of casing pipe, so that the hydraulic cylinders of the pipe extraction machine take care of raising and lowering the section of casing pipe and the clamping device suspended from the latter and thus replace the special hydraulic press arrangement. The clamping device is naturally set-up for repeated engagement of the pile to be extracted, so that the pile is drawn-out progressively by simply raising and lowering the section of casing pipe together with the clamping device.

The invention also makes it possible to extract piles which are located deep in the ground. The earth above the upper end of a pile is previously excavated, in order that the clamping device is able to engage. This effect is achieved due to the fact that the section of casing pipe is provided on its upper end with connecting means for the attachment of a further casing pipe. In this way, the section of casing pipe can be extended as desired, so that the clamping device can be lowered to a considerable depth while a length of casing pipe remains in the region of the pipe extraction machine for engagement by the clamping jaws of the pipe extraction machine. Naturally, the section of casing pipe may also be extended by welding one or several casing pipes.

One embodiment of an apparatus according to the invention is illustrated in the drawings in which.

Figure 1:
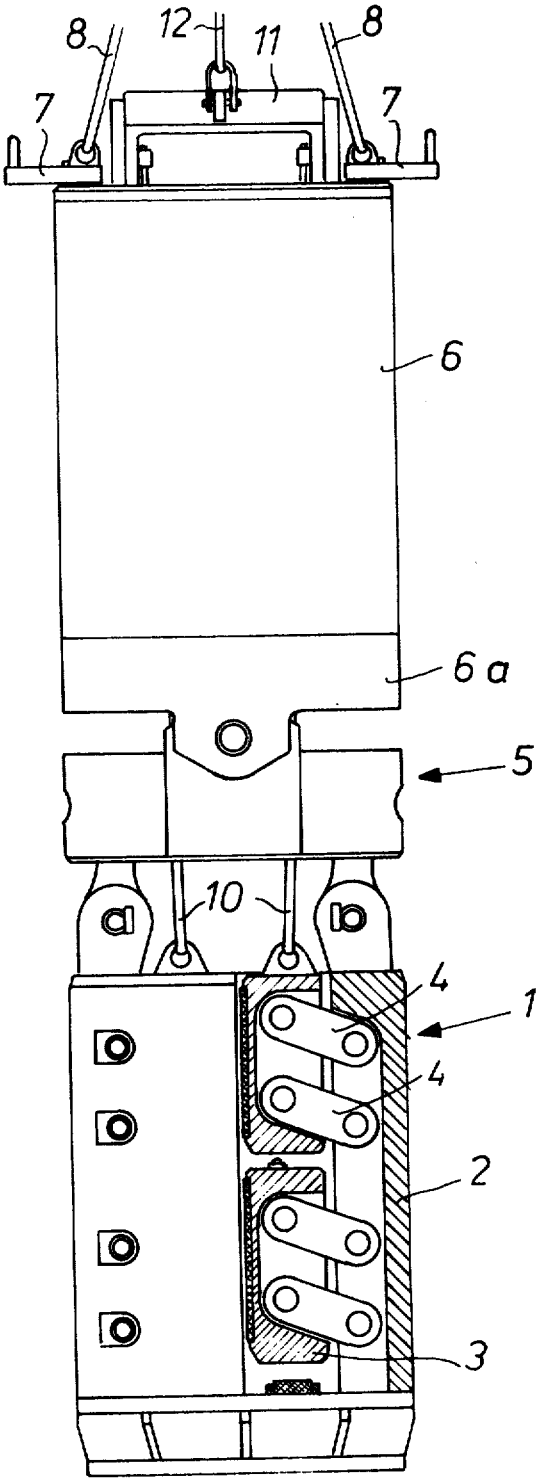
FIG. 1 is a side elevation partly in section of the apparatus.
Figure 2:
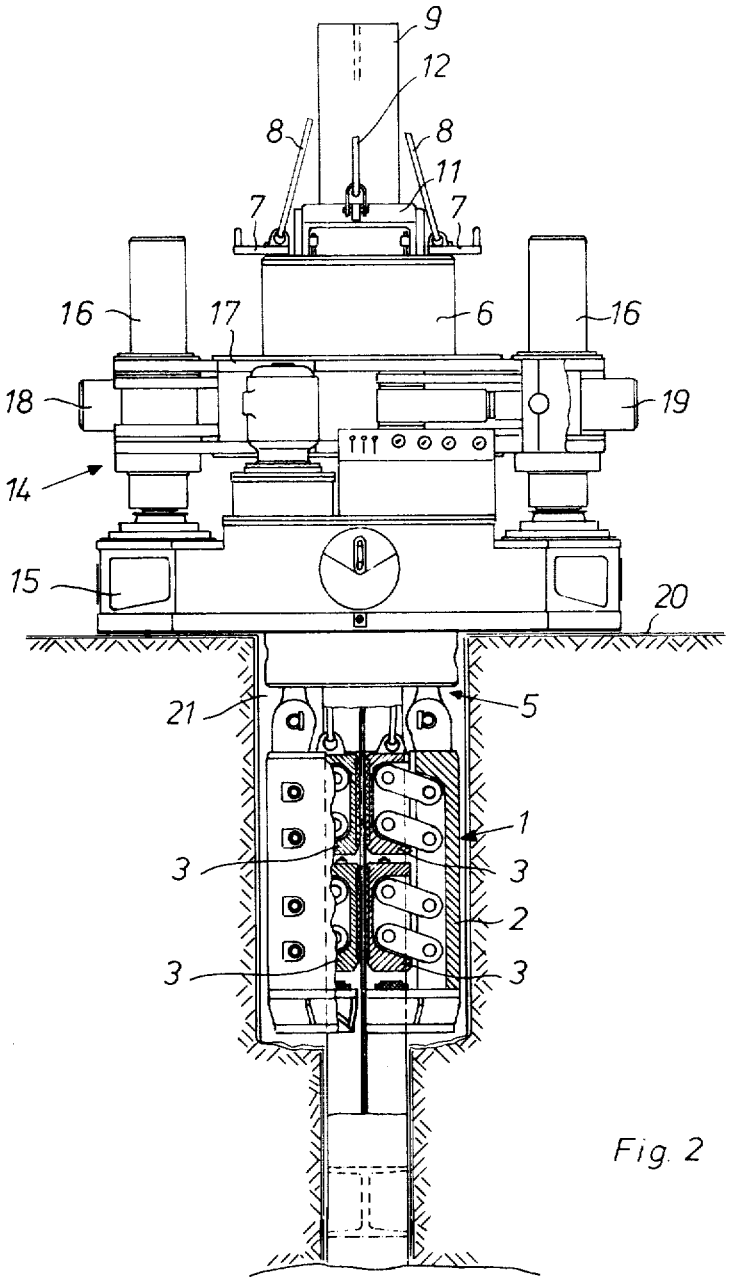
FIG. 2 shows the overall arrangement with pipe extraction machine in use.

The drawing apparatus illustrated in FIG. 1 firstly comprises a clamping device 1, which consists of a heavy pipe 2, in which are located two pairs of opposed clamping jaws 3 pivotally connected to the pipe by way of links 4 forming parallelograms. The links 4 extend obliquely upwards towards the inside when the clamping jaws bear against the web of an H-girder pile 9 to be extracted (FIG. 2). Due to the predetermined inclined position of the links 4, the clamping device 1 is automatically locked on to the pile 9 when the clamping device is moved upwards. In order that the clamping device 1 can be moved upwards without entraining the pile 9, cables 10 are connected to the clamping jaws 3 to swing the jaws 3 upwards and outwards, as will be described hereafter.

The clamping device 1 is connected by way of a universal joint 5, whose construction does not need to be described in detail, to a connecting member 6a of a hollow cylindrical section 6 of casing pipe. The connecting member 6a is connected to the section 6 of casing pipe so that it will withstand tension, in a manner which is not shown in detail. Attached to the upper end of the section 6 of casing pipe are detachable connecting members 7 for cables 8 by which the entire extraction apparatus may be suspended from and manipulated by a crane.

The cables 10 for lifting the clamping jaws 3 are connected to a box-like part 11 located at the upper end of the casing pipe section 6. The opening of the part 11 is greater than the contour of the pile 9 to be extracted. A pair of cables 12 connects the box-like part 11 to a winch which is not shown. Normally, during manipulation of the extracting apparatus by means of the cables 8, the cables 12 are left slack, since the box-like part 11 is supported on the upper end of the section 6 of casing pipe. However, for any vertical position of the drawing apparatus, the clamping jaws 3 can be raised by tightening the pair of cables 12.

Due to the connection of the clamping device 1 by way of the universal joint 5 to a section 6 of casing pipe, the possibility is created of using a commercially available pipe extraction machine 14 (FIG. 2) as the hydraulic press arrangement for applying the tension for a pile 9. In the embodiment, this machine 14 consists of a base-frame 15 with complete hydraulic supply arrangement, two lifting cylinders 16 supported by their piston rods on the base-frame 15 and an arrangement 17 of clamping jaws with clamping cylinders 18 and 19 fixed to the lifting cylinders 16. Further details of the pipe extraction machine 14 are given in Gebrauchsmuster 7 718 042 and U.K. Patent Application No. 18768/78.

Reference should be made to FIG. 2 for an explanation of the method of operation of the extraction apparatus. If it is intended to extract a pile, in the form of an H-girder, terminating below the base 20, then a hole 21 must first be excavated, to expose the upper end of the pile 9 for engagement by the lower clamping jaws 3. The pipe extraction machine 14 is then moved into a position such that its central axis aligns approximately with the central axis of the girder 9. Subsequently, the extraction apparatus according to FIG. 1 suspended from the cables 8 is lowered by the crane through the opened clamping jaws 17 of the pipe extraction machine 14, until the clamping jaws 3 of the clamping device 1 arrive at least partly in the region of the exposed end of the pile 9. During this lowering of the drawing apparatus, the latter can be rotated by hand, in order to fit the web of the pile 9 between the clamping jaws 3. This operation is facilitated if the clamping jaws are lifted by tightening the cables 12.

When the clamping device 1 is in the clamping position, the section 6 of casing pipe is located in the region of the clamping jaw arrangement 17 of the pipe extraction machine 14. By pivoting the clamping jaws by means of the clamping cylinders 18 and 19, a rigid connection is produced between the pipe extraction machine 14 and the section 6 of casing pipe. The clamping jaw arrangement 17 is raised by means of the lifting cylinders 16 thereby lifting the clamping device 1 clamped to the pile 9 which thus is raised by the stroke of the lifting cylinders 16. The lifting cylinders 16 are then reversed, whereby the section 6 of casing pipe moves downwards with the clamping device 1, in order to initiate a further extraction operation. The pile 9 which is raised progressively finally emerges at the top, as shown in FIG. 2, through the Cardan suspension 5, the connecting member 6*a*, the section 6 of casing pipe and the box-like part 11.

At its upper end, the section 6 of casing pipe may be provided with connecting means for the attachment of a further hollow cylindrical casing pipe section, for example in accordance with the pipe connection according to Gebrauchsmuster 7 139 612. In this way, it has become possible for the first time to draw-out piles which are located deep in the earth. It is solely necessary to excavate the hole 21 to a sufficient depth and to extend the section 6 of casing pipe according, so that one end of the casing pipe is always in the region of the clamping jaw arrangement 17 of the pipe extraction machine 14.

What is claimed is:

1. Apparatus for enabling step-wise extraction of a pile of non-circular cross-section, such as an H-girder, with a conventional pipe-extraction machine, the apparatus comprising:

clamp means for releasably engaging the pile of non-circular cross-section;

a hollow cylinder having an external diameter of a dimension engageable by the conventional pipe extraction machine;

a universal joint for suspending the clamp means from a lower end of the hollow cylinder such that the clamp means is angularly moveable relative to the hollow cylinder; and a central passage extending upwardly through the clamp means, the universal joint and the hollow cylinder and dimensioned to permit passage of the pile therethrough, whereby when the pipe-extraction machine engages and lifts and lowers the hollow cylinder, the clamp means engages and partially extracts the pile as the hollow cylinder is lifted and releases and slides downward on the pile as the hollow cylinder is lowered, thereby step-wise extracting the pipe upwardly through the central passage of the apparatus.

2. The apparatus of claim 1, wherein the upper end of the hollow cylinder is provided with means for coupling said upper end to a lower end of a further hollow cylinder, whereby said apparatus may be used with the pipe-extraction machine to extract the pile when the pile is located deep in the earth.

3. The apparatus of claim 1, wherein the clamp means comprises a hollow section of heavy pipe, at least one pair of opposing clamping jaws mounted within the pipe section, and respective parallelogram linkages pivotally connecting the clamping jaws to the pipe section, the linkages directed inwardly and upwardly of the pipe section when in use, thereby locking the clamp means onto the pile when the apparatus is lifted.

4. The apparatus of claim 3, further including a frame bearing on an upper end of the hollow cylinder, and a pair of cables each attached at one end to the frame and at the other end to a clamping jaw, whereby the clamping jaws are released from engagement with the pile when the frame is lifted.

5. Apparatus for the step-wise extraction of a pile, such as an H-girder, comprising:

clamp means for releasably engaging the pile;

a hollow cylinder having an external diameter engageable by a pipe-extraction machine;

a universal joint for suspending the clamp means from a lower end of the hollow cylinder such that the clamp means is angularly moveable relative to the hollow cylinder;

a central passage extending upwardly through the clamp means, the universal joint and the hollow cylinder and dimensioned to permit passage of the pile therethrough; and a pipe-extraction machine having a clamping jaw arrangement dimensioned and operative to frictionally clamp onto the hollow cylinder, and having lifting cylinders supported by the earth and operative for lifting and lowering the clamping jaw arrangement and hollow cylinder, whereby the clamp means engages and partially extracts the pile as the hollow cylinder is lifted, and releases and slides downward on the pile as the hollow cylinder is lowered, thereby step-wise extracting the pile upwardly through the central passage.

6. The apparatus of claim 5, wherein the upper end of the hollow cylinder is provided with means for coupling said upper end to a lower end of a further hollow cylinder, whereby said apparatus may be used with the pipe-extraction machine to extract the pile when the pile is located deep in the earth.

7. The apparatus of claim 5, wherein the clamp means comprises a hollow section of heavy pipe, at least one pair of opposing clamping jaws mounted within the pipe section, and respective parallelogram linkages pivotally connecting the clamping jaws to the pipe section, the linkages directed inwardly and upwardly of the pipe section when in use, thereby locking the clamp means onto the pile when the apparatus is lifted.

8. The apparatus of claim 7, further including a frame bearing on an upper end of the hollow cylinder, and a pair of cables each attached at one end to the frame and at the other end to a clamping jaw, whereby the clamping jaws are released from engagement with the pile when the frame is lifted.

* * * * *